US006634869B2

(12) United States Patent
Britz

(10) Patent No.: US 6,634,869 B2
(45) Date of Patent: Oct. 21, 2003

(54) PISTON PUMP WITH PISTON SPRING-BIASED TO FILTER PISTON

(75) Inventor: Rory Britz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 36 days.

(21) Appl. No.: 10/075,497

(22) Filed: Feb. 13, 2002

(65) Prior Publication Data

US 2002/0110464 A1 Aug. 15, 2002

(30) Foreign Application Priority Data

Feb. 14, 2001 (DE) ..... 101 06 758

(51) Int. Cl.[7] ..... F04B 53/00

(52) U.S. Cl. ..... 417/313; 417/440; 417/555.1; 210/388; 210/416.1

(58) Field of Search ..... 417/313, 401, 417/440, 502, 555.1; 210/388, 390, 416.1

(56) References Cited

U.S. PATENT DOCUMENTS 4,718,893 A * 1/1988 Dorman et al. ..... 604/67
4,961,846 A * 10/1990 Isakson ..... 210/131

* cited by examiner

*Primary Examiner*—Charles G. Freay
*Assistant Examiner*—John F Belena
(74) *Attorney, Agent, or Firm*—Sidley Austin Brown & Wood, LLP

(57) ABSTRACT

A piston pump comprised of a cylinder (2), an automatically closing intake valve (3) to a pump chamber (4), a sealing reciprocating piston (5) and a sealing upstream filter piston (7), wherein the piston (5) together with the filter piston (7) are elastically spring-biased and axially limitedly moveable and form together with the filter piston (7) an automatically closing discharge valve (8).

8 Claims, 3 Drawing Sheets

PISTON PUMP WITH PISTON SPRING-BIASED TO FILTER PISTON

BACKGROUND OF THE INVENTION

The invention relates to a piston pump, preferably executed as a bore wash pump, comprised of a back-and-forth moving piston in a cylinder and an integrated filter piston.

Pseudo-continuously operating piston pumps take in fluid in an initial operating stroke through a spring-biased intake valve into a pump chamber and then compress it in a second operating stroke and finally discharge it through an discharge valve.

Wash bore pumps take up bore wash water heavily burdened with solids at low pressure and provide, at separate discharges, both filtered bore wash water and concentrated solid-containing bore wash water at higher pressures. Because of the heavy solid concentration in bore wash water, regular back flushing of the filter is required to prevent permanent clogging of the filter.

According to U.S. Pat. No. 5,534,145, a piston pump includes a filter equipped to purify fluids that is immovably arranged inside the cylinder. No back flushing is possible in such an arrangement.

According to U.S. Pat. No. 3,915,071, a multiple cascade, reciprocating piston, of a piston pump, is designed as a filter piston comprised of porous material that simultaneously compresses and purifies. This type of construction is not suitable for heavily contaminated fluids. Furthermore, back flushing of the filter is not possible with such a construction.

SUMMARY OF THE INVENTION

The object of the present invention is to provide a filtering piston pump for fluids heavily burdened with solids.

This object is achieved, in accordance with the invention, by a piston pump, wherein a sealing reciprocating piston, in a cylinder, has an automatically closing intake valve to a pump chamber with a spring-biased pre-stressed, axially limited, sealing, moving pre-mounted filter piston. The filter piston together with the piston form an automatically closing discharge valve.

In an initial operating stroke, the piston increases the pump chamber by its axial up stroke, whereby a negative pressure is created with the discharge valve closed. Such an arrangement, consequently allows the solid-burdened fluid to flow into the pump chamber through the opened intake valve. In a second operating stroke, the pump chamber is reduced by the down stroke movement and the solid-burdened fluid is compressed, whereby the filter piston arranged upstream is moved toward the piston against the bias and opens the discharge valve. Such an arrangement allows the purified fluid that has been filtered through the filter piston and compressed by the piston to flow out. The fluid with concentrated solids accumulates in the pump chamber. Consequently, the pump function is combined with the filter function in a limited space.

Advantageously, the piston pump comprises an automatically closing concentrate discharge valve to the pump chamber, which releases the fluid containing the concentrated solids at an overpressure in the pump chamber created by the separation by the filter. Consequently, the piston pump can be used to purify even fluids with a heavy burden of solids and fluids that vary markedly in their concentration of solids.

The automatically closing discharge valve is additionally advantageously stroke dependent closing at the terminal side, whereby the discharge valve is closed shortly before the lower dead center of the down stroke by a filter piston abutting the cylinder. Such an arrangement causes a back flow of the purified fluids through the piston filter into the pump chamber. As a result, an overpressure is created in the pump chamber, which, in a third operating stroke, expels the fluid containing the concentrated solids through the concentrate discharge valve. The piston pump is quasi-continuously self-cleaning.

The terminal stroke dependent closing discharge valve is advantageously spring-biased with an discharge valve spring via a tension bar. Consequently, such an arrangement is inexpensive to construct.

Other features and advantages of the present invention will become more apparent from the following description of the invention which refers to the accompanying drawings.

DETAILED DESCRIPTION OF THE INVENTION

Figure 1:
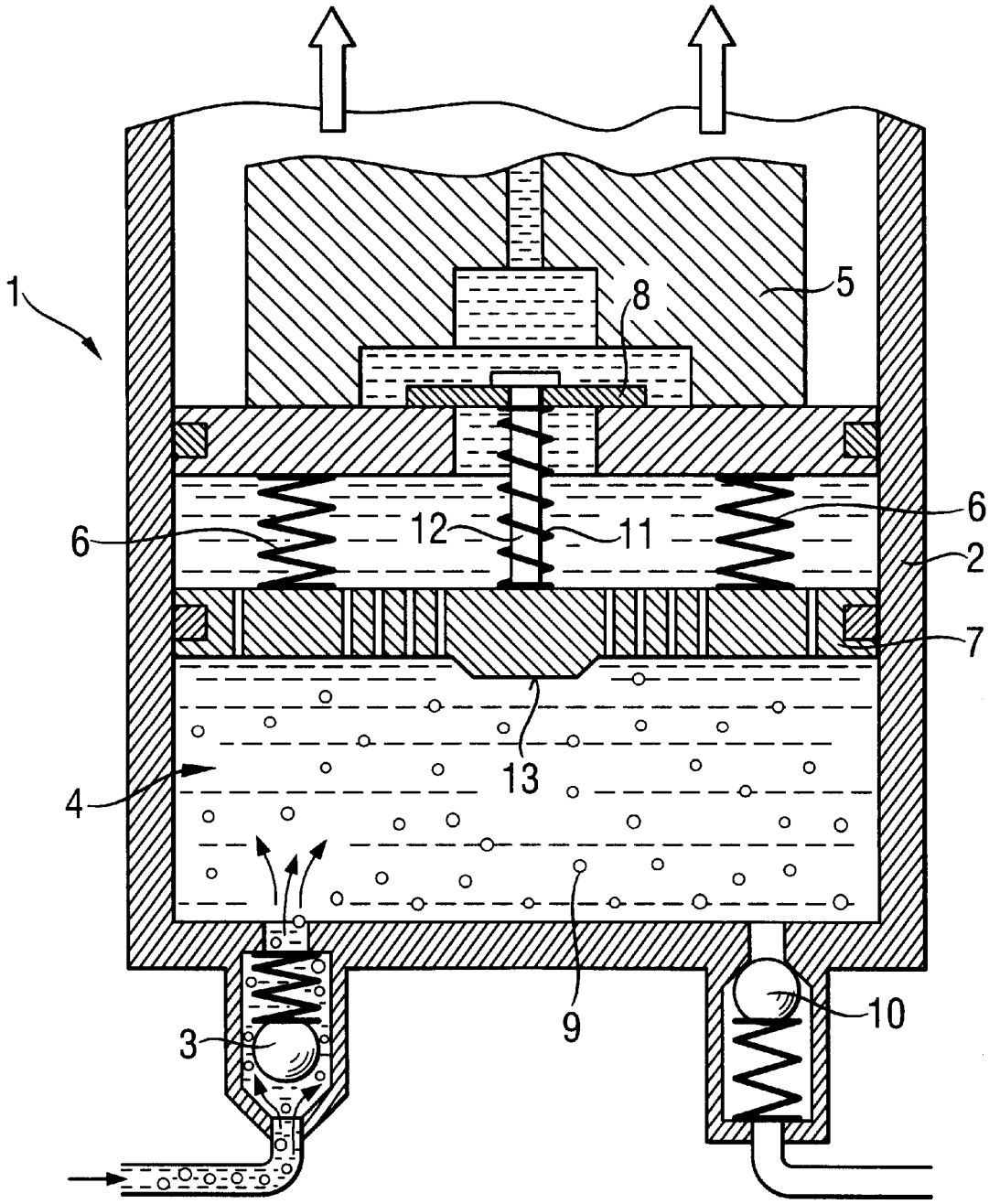
FIG. 1 illustrates the piston pump with the piston filter, at an initial operating stroke, in accordance with the invention.

Referring to FIG. 1, a piston pump 1 comprises a sealing reciprocating piston 5, in a cylinder, with an automatically closing intake valve 3 to a pump chamber 4 and an axially limitedly sealing, moveable filter piston 7 arranged spring-biased upstream thereof using filter springs 6. The filter piston 7 together with the piston 5 form an automatically closing discharge valve 8. The piston 5 increases the pump chamber 4 using an up-stroke. As a result, with the discharge valve 8 closed a negative pressure is created that causes the fluid 9 burdened with solids to flow in through the thusly opened intake valve 3 into the pump chamber.

Figure 2:
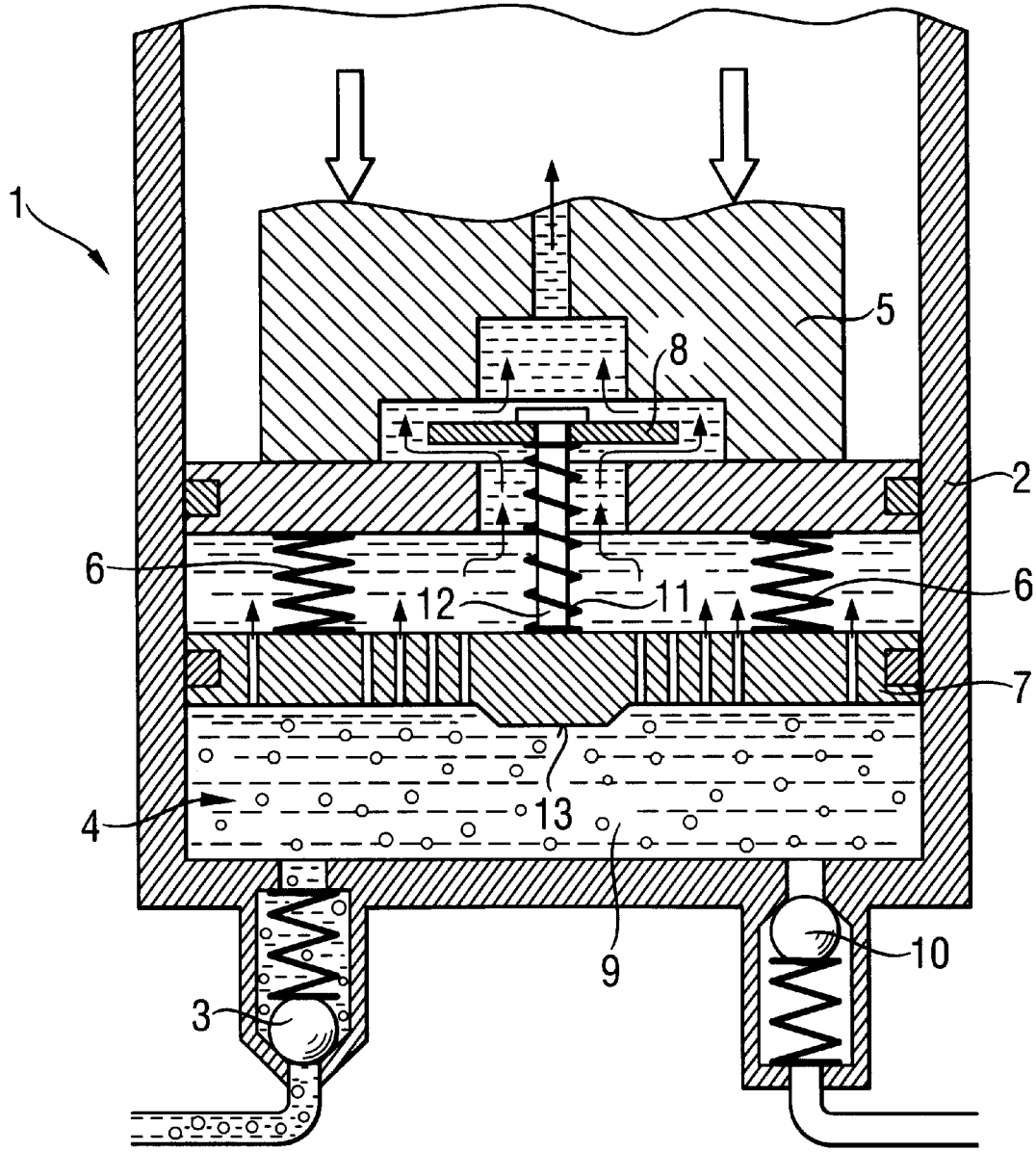
FIG. 2 illustrates the piston pump with piston filter, at a second operating stroke, in accordance with the invention.

Referring to FIG. 2, on the down-stroke, the pump chamber 4 is reduced and the fluid 9 burdened with solids is compressed. As a result, the filter piston 7 is moved toward the piston 5 against the spring-bias of the axially pre-stressed filter springs 6 and the discharge valve 8 opens allowing the purified fluid 9 filtered by the filter piston 7 and compressed by the piston 5 to flow out. The fluid 9 with concentrated solids collects in the pump chamber 4.

Figure 3:
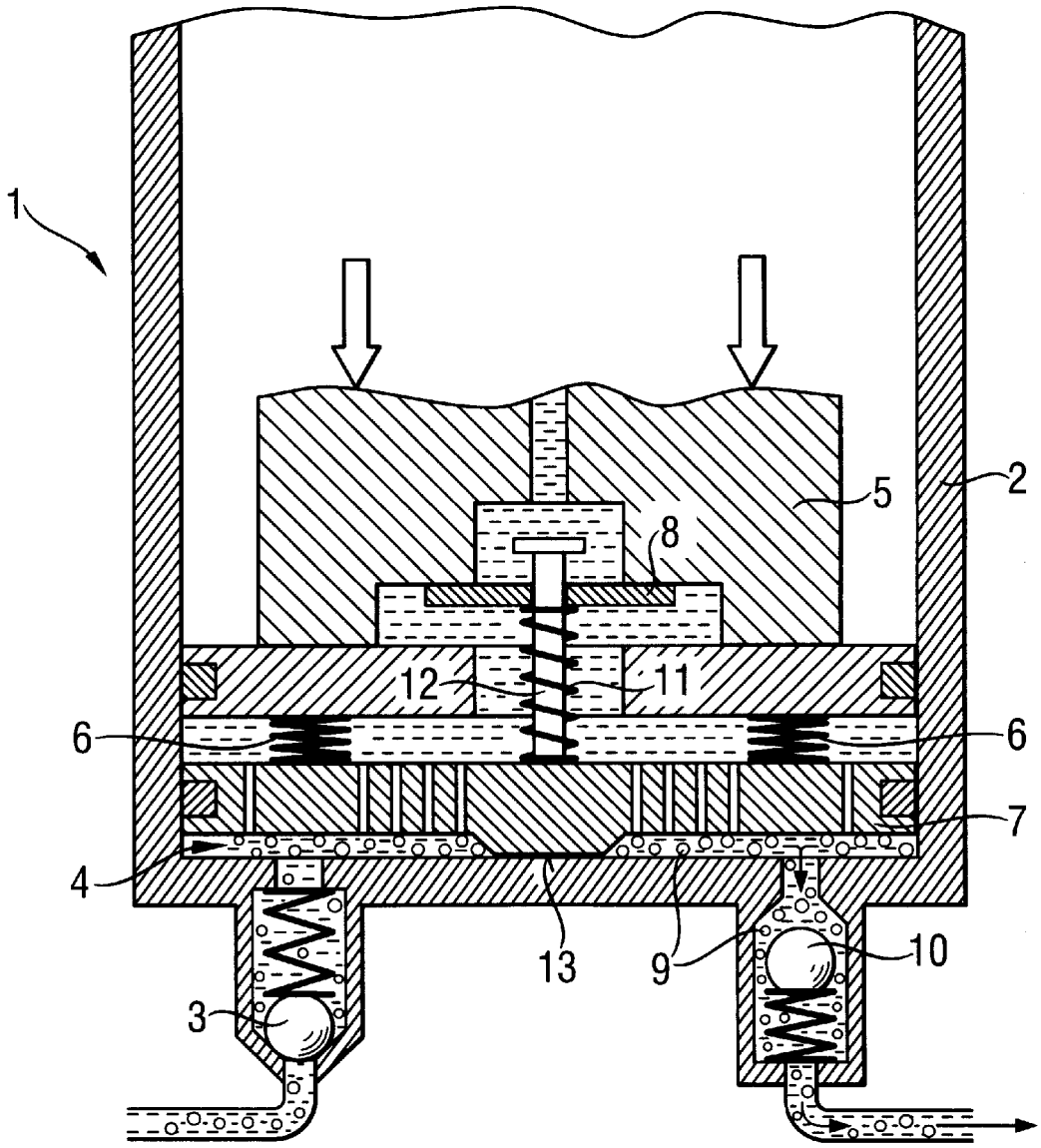
FIG. 3 illustrates as the piston pump with piston filter, at a third operating stroke, in accordance with the invention.

Referring to FIG. 3, the piston pump 1 is characterized by an automatically closing concentrate discharge valve 10 to the pump chamber 4, which in the presence of an overpressure in the pump chamber 4 releases the fluid 9 with concentrated solids. The automatically closing discharge valve 8 is terminally stroke-dependent closing via a pre-stressed discharge valve spring 11 by means of a tension bar 12. The tension bar 12 closes the discharge valve 8 at an axial stop 13 of the filter piston 7 shortly before the lower dead center of the compression stroke and consequently forces a back flow of the purified fluid 9 through the filter piston 7 into the pump chamber 4. As a result, an overpressure is created in the pump chamber 4, wherein the overpressure releases the fluid 9, in which the solids are concentrated, through the concentrate discharge valve.

What is claimed is:

1. A piston pump comprised of a cylinder (2), an automatically closing intake valve (3) to a pump chamber (4), a sealing reciprocating piston (5) and a sealing upstream filter piston (7), wherein the piston (5) is elastically spring biased with the upstream filter piston (7) and wherein the piston (5) together with the filter piston (7) are axially limitedly moveable and form an automatically closing discharge valve (8).

2. The piston pump of claim 1, further comprising an automatically closing concentrate discharge valve (10) to the pump chamber (4).

3. The piston pump of claim 2, further comprising an axial stop (13) formed shortly before a lower dead center of the filter piston (7) and wherein the automatically closing discharge valve (8) is a terminally stroke-dependent closing, producing a back flow of the purified fluid (9) through the filter piston (7) and an overpressure opening of the concentrate discharge valve.

4. The piston pump of claim 3, wherein the terminally stroke-dependent closing discharge valve (8) is spring-biased via a discharge valve spring (11) via a tension bar (12).

5. The piston pump of claim 1, wherein the piston (5) together with the upstream filter piston (7) are connected to each other by at least one axially pre-stressed filter spring (6).

6. A process for the conveyance and filtering of a fluid containing solids, using a piston pump comprised of a cylinder (2), an automatically closing intake valve (3) to a pump chamber (4), a sealing reciprocating piston (5) and a sealing upstream filter piston (7), wherein the piston (5) together with the filter piston (7) form an automatically closing discharge valve (8), the process comprising the steps of: enlarging the pump chamber (4), in an initial operating stroke of the piston (5), by an axial return stroke; creating an overpressure with a closed discharge valve (8) that causes the fluid (9) containing the solids to flow through the opened intake valve (3) into the pump chamber (4); reducing the pump chamber (4), in a second operating stroke of the piston (5), by an axial compression stroke; compressing the fluid (9) containing the solids; moving the upstream filter piston (7) towards the piston (5) against the spring-bias; filtering the fluid (9) through the filter piston (7); opening the discharge valve (8); discharging there-through the purified fluid (9) that was filtered by the filter piston (7) and compressed by the piston (5).

7. The process of claim 6, further comprising the step of discharging the concentrated fluid (9) containing the solids through the concentrate discharge valve (10), in a third operating stroke of the piston (5).

8. The process of claim 7, effecting a back flow of the purified fluid (9) through the filter piston (7) into the pump chamber (4), in the third operating stroke of the piston (5).

* * * * *